US006082137A

United States Patent [19]

Higginbotham

[11] Patent Number: 6,082,137

[45] Date of Patent: Jul. 4, 2000

[54] SEPARATION OF AIR

[75] Inventor: Paul Higginbotham, Guildford, United Kingdom

[73] Assignee: The BOC Group plc, Windlesham, United Kingdom

[21] Appl. No.: 09/274,745

[22] Filed: Mar. 23, 1999

[30] Foreign Application Priority Data

Mar. 24, 1998 [GB] United Kingdom ..... 9806293

[51] Int. Cl.[7] ..... F25J 3/00

[52] U.S. Cl. ..... 62/652; 62/646

[58] Field of Search ..... 62/652, 646

[56] References Cited

U.S. PATENT DOCUMENTS

| | | | |
|---|---|---|---|
| 2,753,698 | 7/1956 | Jakob . | |
| 4,936,099 | 6/1990 | Woodward et al. . | |
| 5,901,576 | 5/1999 | Agrawal et al. | 62/652 |
| 5,956,974 | 9/1999 | Agrawal et al. | 62/652 |

FOREIGN PATENT DOCUMENTS

| | | |
|---|---|---|
| 0 860 670 | 8/1998 | European Pat. Off. . |
| 0 881 446 | 12/1998 | European Pat. Off. . |
| WO88 05148 | 7/1998 | WIPO . |

*Primary Examiner*—Renald Capossela
*Attorney, Agent, or Firm*—Salvatore P. Pace

[57] ABSTRACT

A double rectification column air separation method and apparatus in which a stream of oxygen-enriched liquid air from a higher pressure rectification column is at least partially vaporized in indirect heat exchange with a stream of purified, compressed, gaseous air. The stream of purified, compressed air is condensed and a stream of the resulting vapor after having been warmed is expanded in a turbine with the performance of external work. After expansion, the resulting vapor is introduced into the lower pressure rectification column and a stream of the resulting condensed air is introduced into the higher pressure column at an intermediate mass exchange level thereof.

11 Claims, 4 Drawing Sheets

SEPARATION OF AIR

BACKGROUND OF THE INVENTION

This invention relates to a method and apparatus for the separation of air.

The separation of air by rectification is very well known indeed. Rectification is a method in which mass exchange is effected between a descending stream of liquid and an ascending stream of vapor such that the ascending stream of vapor is enriched in a more volatile component (nitrogen) of the mixture to be separated and the descending stream of liquid is enriched in a less volatile component (oxygen) of the mixture to be separated.

It is known to separate air in a double rectification column comprising a higher pressure rectification column which receives a stream of purified, compressed, vaporous air at a temperature suitable for its separation by rectification, and a lower pressure rectification column which receives a stream of oxygen-enriched liquid air for separation from the higher pressure rectification column, and which is in heat exchange relationship with the higher pressure rectification column through a condenser-reboiler, of which the condenser provides liquid nitrogen reflux for the separation and the reboiler provides an upward flow of nitrogen vapor in the lower pressure rectification column.

There is a net requirement for refrigeration to be provided to the air separation. At least part of this requirement arises from the operation of the double rectification column at cryogenic temperatures. At least part of this requirement for refrigeration is conventionally met by expanding with the performance of external work a part of the incoming air flow or a part of a nitrogen product of the separation.

It is known that the thermodynamic efficiency with which the double rectification column operates can be enhanced by condensing a part of the flow of air to be separated and introducing a stream of resulting liquid air into the higher pressure rectification column at an intermediate mass exchange level thereof.

The improvement in efficiency results from a reduction that can be made in the liquid nitrogen reflux supplied to the top of the higher pressure rectification column. It is similarly advantageous to introduce a stream of liquid air into the lower pressure rectification column at an intermediate mass exchange level thereof.

The condensation of the air does of course introduce a further source of thermodynamic inefficiency into the air separation method. It is therefore desirable to integrate the condensation of the air into the method in such a way that the increased thermodynamic efficiency with which the double rectification column operates outweighs the additional thermodynamic inefficiency introduced by the condensation of the air.

SUMMARY OF THE INVENTION

According to the present invention there is provided a method of separating air in a double rectification column comprising a higher pressure rectification column, which receives a first stream of purified, compressed gaseous air at a temperature suitable for its separation by rectification, and a lower pressure rectification column, which receives a flow of oxygen-enriched liquid air for separation from the higher pressure rectification column, and which is in heat exchange relationship with the higher pressure rectification column through a condenser-reboiler, of which the condenser provides liquid nitrogen reflux for the separation and the reboiler provides an upward flow of vapor in the lower pressure rectification column, characterized in that a stream of oxygen-enriched liquid air from the higher pressure rectification column is at least partially vaporized in indirect heat exchange with a second stream of purified, compressed, gaseous air, the second stream of purified, compressed, gaseous air thereby being condensed, a stream of the resulting vapor is warmed, is expanded in a turbine with the performance of external work, and is introduced in to the lower pressure rectification column, and a stream of the resulting condensed air is introduced into the higher pressure rectification column at an intermediate mass exchange level thereof.

The invention also provides apparatus for the separation of air, comprising a double rectification column comprising a higher pressure rectification column having a first inlet for a first stream of purified, compressed, gaseous air at a temperature suitable for its separation by rectification, and a lower pressure rectification column which has a first inlet for a flow of oxygen-enriched liquid air communicating directly or indirectly with the higher pressure rectification column, and which is in heat exchange relationship with the higher pressure rectification column through a condenser-reboiler, of which the condenser is able to provide liquid nitrogen reflux for the separation, and the reboiler is able to provide an upward flow of vapor in the lower pressure rectification column, characterized in that the apparatus additionally includes a vaporizer for at least partially vaporizing a stream of the oxygen-enriched liquid air indirect heat exchange with a second stream of purified compressed, gaseous air, a second inlet for air to an intermediate mass exchange region of the higher pressure rectification column communicating with an outlet for condensed air from the vaporizer, a heat exchanger for warming a stream of vaporized oxygen-enriched liquid air formed by said indirect heat exchange with the second stream of purified, compressed, gaseous air, and a turbine for expanding the warmed, vaporized, second stream of oxygen-enriched liquid air with the performance of external work, having an outlet communicating with the lower pressure rectification column.

Employing a stream of the oxygen-enriched liquid air to condense the second stream of purified, compressed, gaseous air facilitates thermodynamically efficient operation of the air separation method and apparatus according to the invention. First, it is readily possible to achieve quite efficient heat exchange between the vaporizing oxygen-enriched liquid air and the condensing air. Secondly, the use of the resulting condensed air stream in the double rectification column counteracts the tendency for a turbo-expander exhausting into the lower pressure to deprive of reflux the section of the lower pressure rectification column above the inlet for the turbo-expanded air. This counteraction takes place because the introduction of the stream of condensed air into the higher pressure rectification column reduces the amount of liquid nitrogen reflux that is required for the high pressure column and thereby increases the amount available as reflux in the lower pressure rectification column and/or as product nitrogen.

Preferably, the entire supply of condensed liquid air to the double rectification column is from the heat exchange with the stream of oxygen-enriched liquid air, apart from any liquid air produced at the outlet of the turbine and/or any other turbine employed in the method according to the invention.

Preferably, the second stream of purified, compressed, gaseous air is condensed at a higher pressure than that at which the first stream of purified, compressed, gaseous air enters the higher pressure rectification column. Alternatively, the second stream of purified, compressed, gaseous air is condensed at essentially the same pressure as that at which the first stream of purified, compressed, gaseous air enters the higher pressure rectification column, and the stream of oxygen-enriched liquid air is throttled upstream of its heat exchange with the second stream of purified, compressed, gaseous air. It is also possible both to throttle the stream of oxygen-enriched liquid air upstream of its heat exchange with the second stream of purified, compressed, gaseous air and to condense the second stream of purified, compressed, gaseous air at a higher pressure than that at which the first stream of purified, compressed gaseous air enters the higher pressure rectification column. In another alternative the stream of oxygen-enriched liquid air is pumped to a higher pressure than that at which the higher pressure rectification column operates. As a result it is possible to increase the amount of refrigeration produced by the expansion turbine. In each of these examples the pressure of the condensing air and the pressure of the vaporizing oxygen-enriched liquid air are desirably so selected as to enable favorable temperature-enthalpy conditions to be maintained in the vaporizer.

Preferably, only part of the oxygen-enriched liquid air withdrawn from the higher pressure rectification column is introduced into indirect heat exchange relationship with the second stream of oxygen-enriched liquid air, but this part is totally vaporized. It is alternatively possible to send all the oxygen-enriched liquid withdrawn from the higher pressure rectification column to the heat exchange with the second purified, compressed, gaseous air stream but to vaporize only part of the oxygen-enriched air in the heat exchange. The resulting mixture of vapor and residual liquid is then subjected to phase separation, with the vapor phase flowing to the turbine, and the liquid phase flowing to the lower pressure rectification column.

The said turbine is preferably the sole turbine employed in the method and apparatus according to the invention, particularly if it is not desired to produce a liquid nitrogen product. The turbine is preferably employed to drive a compressor which raises the pressure of the second purified compressed air stream to above that of the first purified compressed air stream.

The method and apparatus according to the invention are particularly suited for operation and relatively elevated pressure. Thus, for example, the lower pressure rectification column may operate at a pressure typically in the range of about 2 to about 5 bar at its top.

The air streams to be separated may be taken from a source of compressed air which has been purified by extraction therefrom of water vapor, carbon dioxide and, if desired, hydrocarbons, and which has been cooled in indirect heat exchange with products of the air separation.

The rectification column may be any distillation or fractionation column, zone or zones in which liquid and vapor phases are countercurrently contacted to effect separation of a fluid mixture, as, for example, by contacting the vapor and liquid phases on packing elements or a series of vertically spaced trays or plates mounted within the column, zone or zones. A rectification column may comprise a plurality of zones in separate vessels so as to avoid having a single vessel of undue height.

The method and apparatus according to the present invention find two main uses. The first of those uses is when an oxygen product, typically at least 90% pure, is withdrawn from the lower pressure rectification column entirely in gaseous state. The second use is when a first nitrogen product is withdrawn from the lower pressure rectification column, and at least one second nitrogen product, either in gaseous or liquid state, is withdrawn from the higher pressure rectification column, but the oxygen produced at the bottom of the lower pressure rectification column is typically less than about 90% pure.

The second use will now be considered in more detail. In order to produce additional liquid nitrogen reflux for the double rectification column, nitrogen separated in the lower pressure rectification column is condensed (in a further condenser) by indirect heat exchange with a stream of impure liquid oxygen withdrawn from the lower pressure rectification column.

Many industrial processes, for example, the enhanced recovery of oil or gas, require nitrogen to be supplied at an elevated pressure, often well in excess of that at which the higher pressure rectification column operates. Taking a nitrogen vapor product from the higher pressure rectification column reduces the amount of work required to raise the pressure of the nitrogen product to that demanded by the process to which the nitrogen is to be supplied.

A feature of such nitrogen generators is that for a given size and a given purity and pressure of the nitrogen products the total power consumption at first falls with increasing nitrogen recovery to a minimum and then rises again. This phenomenon results from two opposing factors. The ideal separation work. (and hence power consumption) is at a minimum when the nitrogen recovery is very low and the waste product is still essentially air. It is at a maximum when the waste gas contains no nitrogen. However, the process efficiency (actual work input/ideal work input) is very low when the recovery is very low because the plant is much bigger than it needs to be and losses of work arising from pressure drops and temperature differences are large. Conversely, when the recovery is high the process efficiency is higher. There is a minimum power consumption at an optimum recovery, which is achieved when the falling separation power is just balanced by the increasing losses of work that are caused by the plant getting larger. The total power consumption also includes power consumed in compressing the nitrogen product. Taking a part of the nitrogen product from the higher pressure rectification column reduces the power consumed in compressing the nitrogen products but reduces the nitrogen recovery.

Other expedients may also decrease the nitrogen recovery. For example, the production of a liquid nitrogen product requires a part of the incoming air to be condensed. This in turn reduces the vapor flow available for condensation in the condenser-reboiler. Again, in order to compensate, a larger, less efficient plant is required.

In practice, double column air separation plants for generating nitrogen are not necessarily designed either for a minimum power consumption or for maximum nitrogen recovery. Rather, there is generally a preferred operational envelope represented by a particular region of a graph of power consumption plotted against nitrogen recovery, the actual optimum depending on extraneous economic circumstances. The method and apparatus according to the present invention enables the preferred operational envelope to be shifted in the direction of reduced power consumption without reducing nitrogen recovery, or in the direction of increased nitrogen recovery without increasing power consumption, or in both directions.

Thus, the method and apparatus according to the invention enable relatively efficient operation (e.g. with relatively low power consumption and with an appropriate number of theoretical trays in the higher and lower pressure rectification columns) of the overall air separation process to be maintained under conditions of relatively high nitrogen recovery which would otherwise lead to inefficient operation of the conventional process not employing the characterizing features of the invention. In particular, the method and apparatus according to the invention allow the lower pressure rectification column to be operated at a pressure in excess of about 3.5 bar absolute while at the same time enabling a nitrogen product to be taken, particularly in the vapor state, from the higher pressure rectification column at a pressure in excess of about 8.5 bar absolute. In a typical example, at constant air compression power, about 57% of the total nitrogen product may be taken from the higher pressure rectification column at about 90% nitrogen recovery, whereas in a comparable conventional double column process only about 48% of the total nitrogen product is produced at the pressure of the higher pressure rectification column. Because a greater proportion of the nitrogen is taken from the higher pressure rectification column, the total power consumption is reduced when producing a nitrogen product at a pressure above that of the higher pressure rectification column. Taking an increased share of the nitrogen product from the higher pressure rectification column is not the only way of realizing a lower power consumption. It is alternatively possible in some examples of the method and apparatus according to the invention to keep this share constant, and reduce the power consumed by increasing the nitrogen recovery. The method and apparatus according to the invention alternatively makes possible at a given nitrogen recovery and power consumption storage of a liquid nitrogen product at a greater rate than in comparable known processes.

BRIEF DESCRIPTION OF THE DRAWINGS

The method and apparatus according to the present invention will now be described by way of example with reference to the accompanying drawings, in which.

Figure 1:
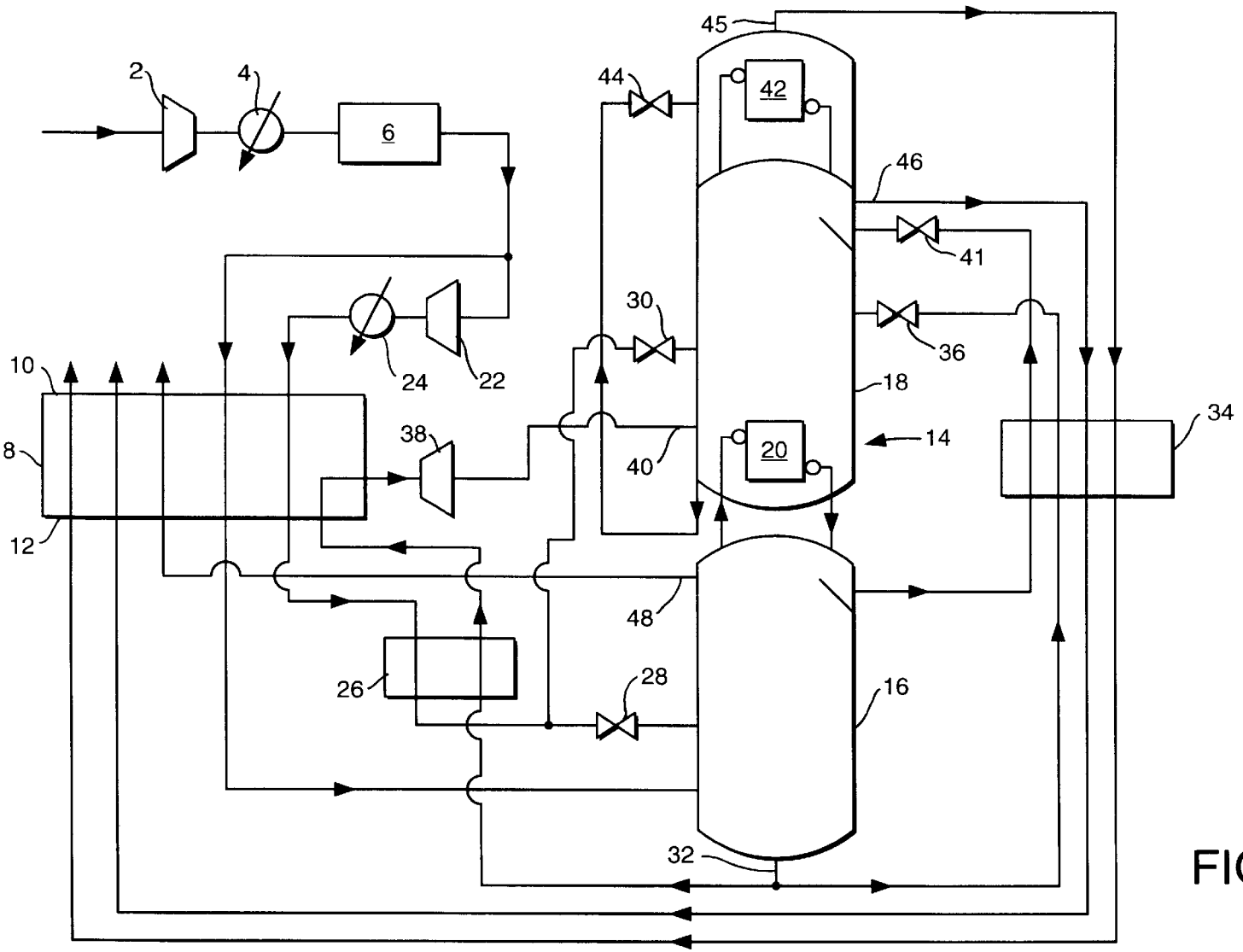
FIGS. 1 to 4 are all schematic flow diagrams of air separation plants.

The drawings are not to scale.

Like parts in the drawings are indicated by the same reference numerals.

DETAILED DESCRIPTION OF THE INVENTION

Referring to FIG. 1 of the drawing, a flow of air is compressed in a main air compressor 2. Heat of compression is extracted from the resulting compressed air in an aftercooler 4 associated with the main air compressor 2. The thus cooled air stream is purified in an adsorption unit 6. The purification comprises removal from the air flow of relatively high boiling point impurities, particularly water vapor and carbon dioxide, which would otherwise freeze in low temperature parts of the plant. The unit 6 may effect the purification by pressure swing adsorption or temperature swing adsorption. The unit 6 may additionally include one or more layers of catalyst for the removal of carbon monoxide and hydrogen impurities. Such removal of carbon monoxide and hydrogen impurities is described in EP-A-438 282. The construction and operation of adsorptive purification units are well known and need not be described further herein.

Downstream of the purification unit 6, the air is divided into first and second purified compressed air streams. The first purified compressed air stream flows through a main heat exchanger 8 from its warm end 10 to its cold end 12. The air is thereby cooled to a temperature suitable for its separation by rectification and hence leaves the cold end 12 of the main heat exchanger 8 in a vaporous state.

The compressed, vaporous, first air stream is separated in a double rectification column 14 comprising a higher pressure rectification column 16, a lower pressure rectification column 18, and a condenser-reboiler 20, of which the condensing passages (not shown) communicate with an upper region of the higher pressure rectification column 16 so as to condense nitrogen separated therein, and the reboiling passages (not shown) communicate with the lower region of the lower pressure rectification column 18.

The first stream of vaporous compressed air enters the bottom of a lower region of the higher pressure rectification column 16. The higher rectification column 16 contains members (not shown) defining liquid-vapor contact surfaces so as to bring into intimate mass transfer relationship the vapor ascending the column with liquid nitrogen descending the column, this liquid nitrogen being formed by condensation of nitrogen vapor in the condenser-reboiler 20. As a result of the mass transfer, nitrogen is separated from the first stream of compressed, vaporous air.

The second stream of purified compressed air is further compressed in a booster-compressor 22. Heat of compression is removed from the further compressed second air stream in an after cooler 24. The thus cooled second purified compressed air stream is further cooled by passage through the main heat exchanger 8 from its warm end 10 to its cold end 12. Downstream of the cold end 12 and the main heat exchanger 8, the second stream of purified compressed air passes into a condensing heat exchanger 26 (which also acts as a vaporizer) in which it is condensed. A first stream of the resulting condensate passes through a first throttling valve 28 and is introduced into an intermediate mass exchange region of the higher pressure rectification column 16. A second stream of the condensate passes through a further throttling valve 30 and is introduced into an intermediate mass exchange region of the lower pressure rectification column.

A stream of oxygen-enriched liquid is withdrawn from the bottom of the higher pressure rectification column 16 through an outlet 32. This stream is divided into two subsidiary streams. The first subsidiary stream flows through a heat exchanger 34 and is sub-cooled therein. The sub-cooled subsidiary oxygen-enriched liquid air stream flows through a throttling valve 36 and is introduced into an intermediate mass exchange region of the higher pressure rectification column 16 below that into which the second stream of condensate from the heat exchanger 26 is introduced.

The second subsidiary stream of the oxygen-enriched liquid air flows through the heat exchanger 26 and is vaporized therein by indirect heat exchange with the condensing second purified compressed air stream. The vaporized second subsidiary stream of oxygen-enriched liquid air is further rewarmed by passage through the main heat exchanger 8 from the cold end 12 to an intermediate region thereof. It is withdrawn from the main heat exchanger 8 at this intermediate region and is expanded with the performance of external work in a turbine 38. If desired, the turbine 38 may be coupled to, and thereby drive, the booster-compressor 22. The expanded vaporized second subsidiary stream of the oxygen-enriched liquid air is introduced through an inlet 40 into an intermediate mass exchange region of the lower pressure rectification column, 18 below that into which the first sub-cooled subsidiary stream of oxygen-enriched liquid air is introduced.

The air is separated in the lower pressure rectification column 18 into a top nitrogen fraction and a bottom impure liquid oxygen fraction. The reboiler of the condenser-reboiler 20 provides the necessary upward flow of vapor in the column 18. Liquid nitrogen reflux for the column 18 is provided from two sources. The first source is the condensing passages of the reboiler-condenser 20. A stream of condensed liquid nitrogen is taken therefrom via the top region of the higher pressure rectification column 16, is sub-cooled by passage through the heat exchanger 34, is passed through a throttling valve 41 and is introduced into a top region of the lower pressure rectification column 18. A second source is a further condenser 42. A part of the nitrogen vapor fraction separated in the lower pressure rectification column 18 is condensed in the further condenser 42 and the resulting condensate is returned to the top of the column 18 as a reflux. Cooling for the condenser 42 is provided by withdrawing a stream of the impure liquid oxygen from the bottom of the lower pressure rectification column 18 and passing it through a throttling valve 44. As a result of its heat exchange with the condensing nitrogen in the further condenser 42, the impure liquid oxygen stream is vaporized. The resulting vapor passes out of the condenser 42 through an outlet 45 and is warmed by passage through the heat exchanger 34 and the main heat exchanger 8. The resulting warmed impure oxygen stream is discharged into the atmosphere as waste from the warm end 10 of the main heat exchanger 8.

A first nitrogen product stream is withdrawn as vapor through an outlet 46 from the top of the lower pressure rectification column 18, and, downstream of passage through the heat exchanger 34 is warmed to approximately ambient temperature by passage through the main heat exchanger 8 from its cold end 12 to its warm end 10. A second nitrogen product is taken, also in a vapor state, from the top of the higher pressure rectification column 16 through an outlet 48 and is warmed to approximately ambient temperature by passage through the main heat exchanger 8 from its cold end 12 to its warm end 10.

In a typical example of the operation of the air separation plant shown in the drawing, the higher pressure rectification column 16 operates in a pressure of about 9.5 bar at its top and the lower pressure rectification column 18 at a pressure of about 4.2 bar at its top. The booster-compressor 22 raises the pressure of the second purified compressed air stream from about 9.8 bar to about 11.5 bar. The further condenser 42 operates at about a pressure of about 1.4 bar. The oxygen-enriched liquid air flow withdrawn through the outlet 32 from the bottom of the higher pressure rectification column 16 typically has an oxygen mole fraction of about 0.35. The impure liquid oxygen withdrawn from the bottom of the lower pressure rectification column has an oxygen mole fraction of about 0.73.

In this example 57% of the total nitrogen product is taken from the higher pressure rectification column 16 and the nitrogen recovery is about 90%. This compares with a comparable conventional double column air separation process in which only about 48% of the total nitrogen product can be taken from the higher pressure rectification column when the nitrogen recovery is about 90%.

Figure 2:
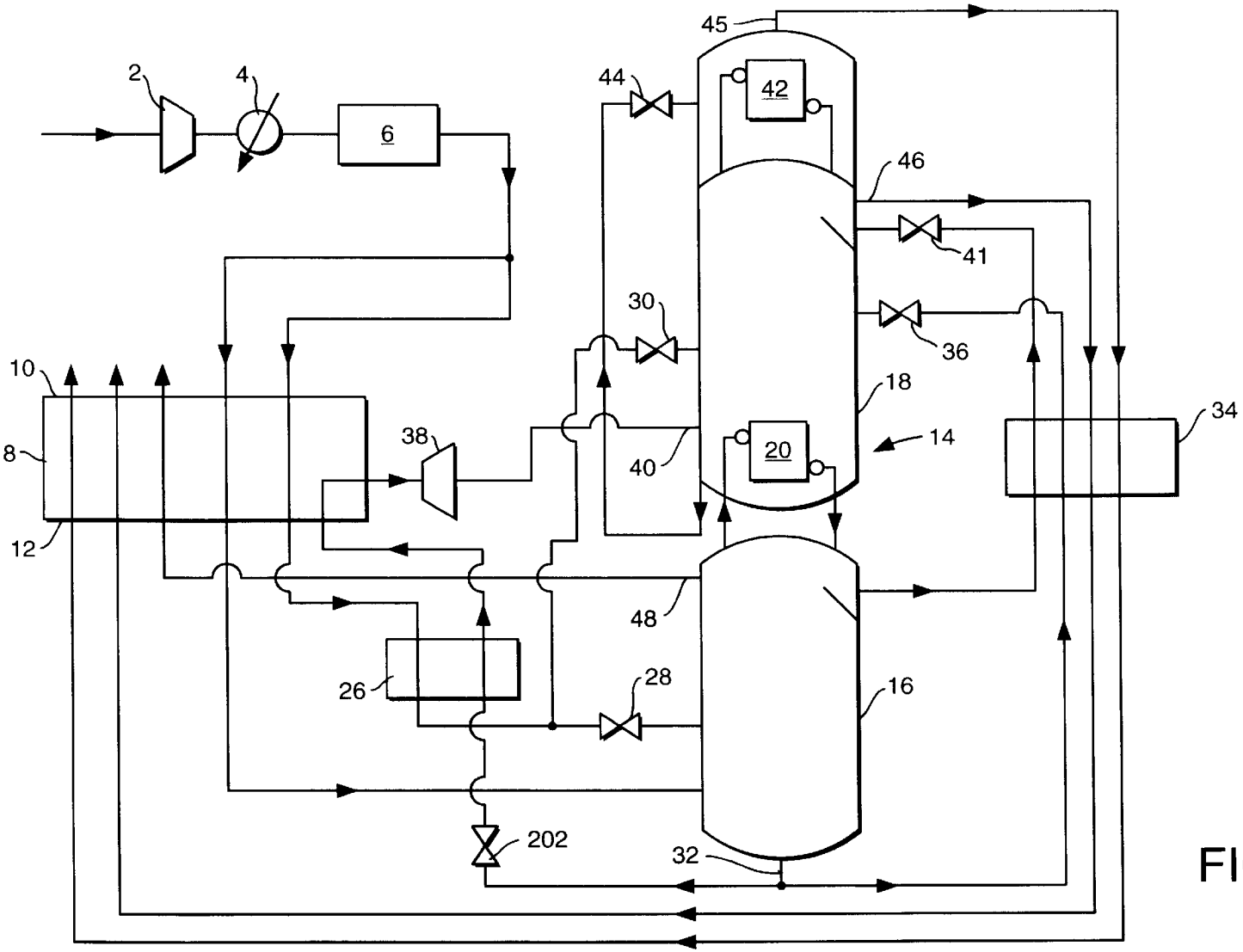

Referring to FIG. 2, the plant shown therein is generally similar to that shown in FIG. 1 with the exceptions that the expansion turbine 22 and its associated aftercooler 24 are omitted (with the consequence that the second purified, compressed, gaseous air stream is condensed at essentially the same pressure as that at which the first purified, compressed, gaseous air stream enters the higher pressure rectification column 16) and that the stream of oxygen-enriched liquid air which is vaporized is reduced in pressure by passage through a throttling valve 202 upstream of the heat exchanger 26.

Figure 3:
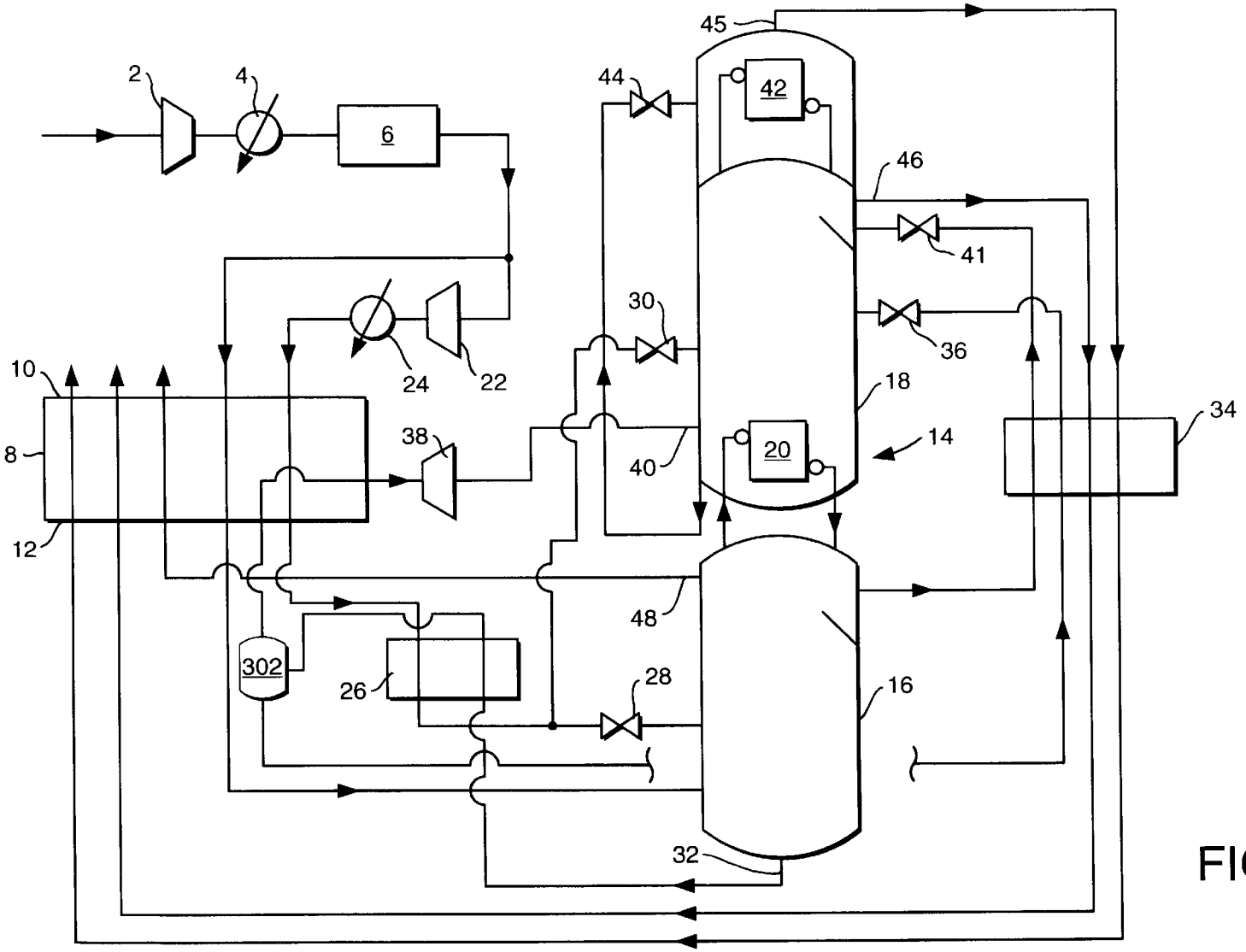

The plant shown in FIG. 3 is also generally similar to that shown in FIG. 1. However, all the oxygen-enriched liquid air withdrawn from the higher pressure rectification column 16 through the outlet 32 flows through the heat exchanger 26. The oxygen-enriched liquid air is partially vaporized in the heat exchanger 26. The resulting partially vaporized stream flows into a phase separator 302 in which the liquid phase is disengaged from the vapor phase. The vapor phase flows from the phase separator 302 via the main heat exchanger to the expansion turbine 38. The liquid phase is sub-cooled in the heat exchanger 34 upstream of being introduced into the lower pressure rectification column 18 via he throttling valve 36.

Figure 4:
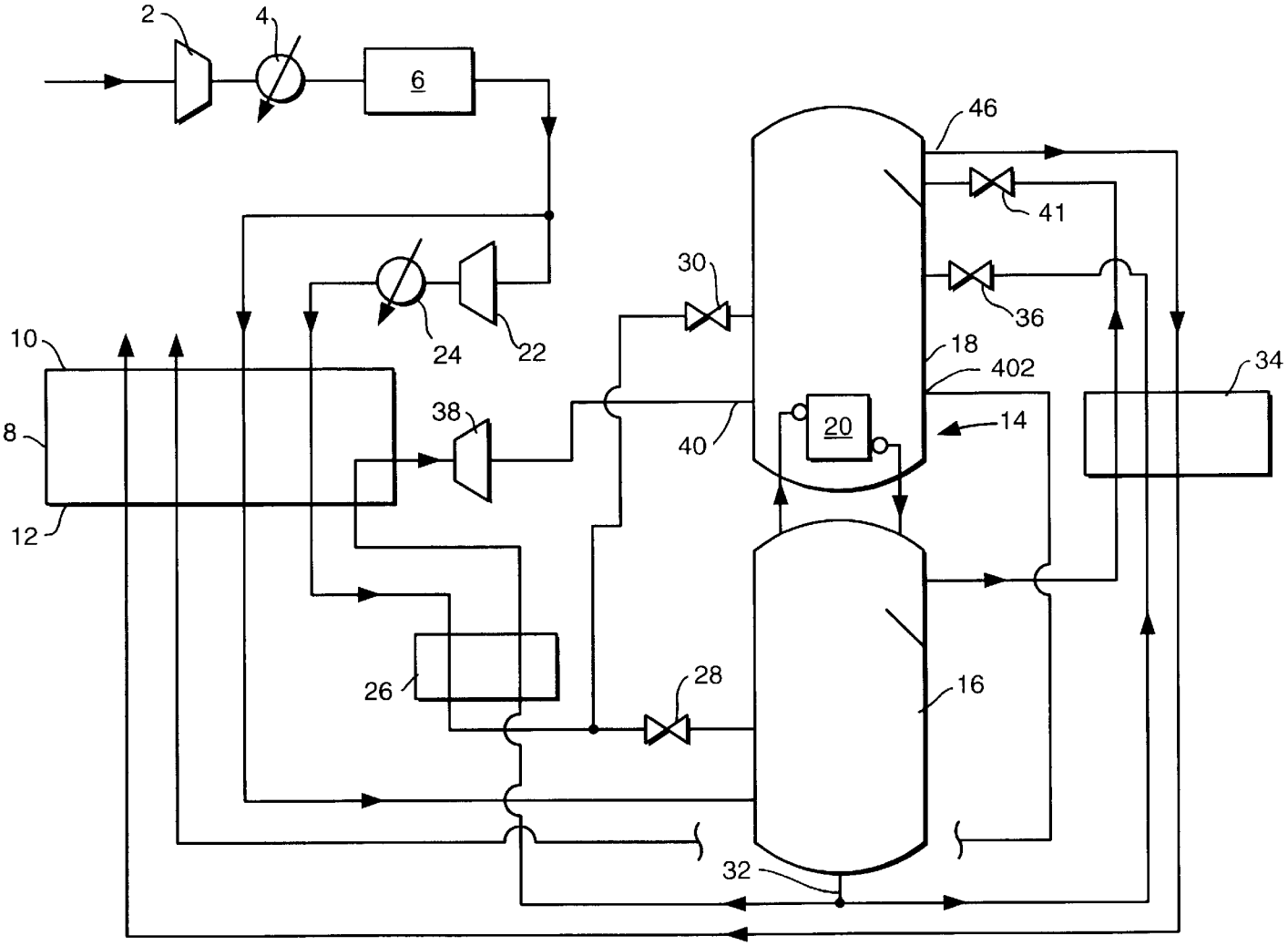

Whereas the plants shown in FIGS. 1 to 3 produce nitrogen and a waste oxygen product the latter containing more than about 10% by volume of impurities, the plant shown in FIG. 4 produces an oxygen product containing less than 1% by volume of impurities. This oxygen product is withdrawn from the lower pressure rectification column through an outlet 402 in vapor state and is warmed to approximately ambient temperature by passage through the main heat exchanger 8 from its cold end 12 to its warm end 10. Although in most respects the plant shown in FIG. 4 resembles that illustrated in FIG. 1, the thermal load on the condenser-reboiler 20 is greater in the latter. Accordingly, no vaporous nitrogen product is withdrawn from the higher pressure rectification column 16. In addition, the condenser 42 is omitted from the plant shown in FIG. 4 and the liquid which would have been reboiled therein is reboiled in the condenser-reboiler 20 instead.

I claim:

1. A method of separating air:

introducing a first stream of purified, compressed, gaseous air at a temperature suitable for its separation by rectification into a higher pressure rectification column of a double rectification column;

the double rectification column also having a lower pressure rectification column in heat exchange relationship with the higher pressure rectification column through a condenser reboiler, of which said condenser-reboiler provides liquid nitrogen reflux for separation and an upward flow of vapor in the lower pressure column;

introducing a flow of oxygen-enriched air produced in the higher pressure rectification column into the lower pressure rectification column for separation;

at least partially vaporizing a stream of oxygen-enriched liquid air from the higher pressure rectification column through indirect heat exchange with a second stream of purified, compressed, gaseous air to produce resultant vapor, the second stream of purified, compressed, gaseous air thereby being condensed to produce condensed air;

warming and then expanding in a turbine with the performance of work, a stream of said resultant vapor;

introducing said resultant vapor from the turbine into the lower pressure rectification column; and introducing a stream of said condensed air into the higher pressure rectification column at an intermediate mass exchange level thereof.

2. The method according to claim 1, in which the second stream of purified, compressed, gaseous air is condensed at a higher pressure than that at which the first stream of purified, compressed, gaseous air enters the higher pressure rectification column.

3. The method according to claim 1, in which the second stream of purified, compressed, gaseous air is condensed at essentially the same pressure as that at which the first stream of purified, compressed gaseous air enters the higher pressure rectification column, and the stream of oxygen-enriched liquid air is throttled upstream of its heat exchange with the second stream of purified, compressed, gaseous air.

4. The method according to claim 1, in which only part of the oxygen-enriched liquid air withdrawn from the higher pressure rectification column is introduced into indirect heat relationship with the second stream of oxygen-enriched liquid air, but this part is totally vaporized.

5. The method according to claim 1, in which all the oxygen-enriched liquid air withdrawn from the higher press rectification column is passed into heat exchange relationship with the second purified, compressed, gaseous air stream, but only part of the oxygen-enriched liquid air is vaporized in the heat exchange to produce a resulting mixture of vapor and residual liquid.

6. The method according to claim 5, in which said resulting mixture of vapor and residual liquid is subjected to phase separation to form the resultant vapor expanded in the turbine and a liquid phase flowing to the lower pressure rectification column.

7. The method according to claim 1, in which said turbine is solely employed without any additional turbine.

8. The method as claimed in claim 1, in which the lower pressure rectification column operates at a pressure in the range of between about 3.5 and about 6 bar at its top.

9. The method according to claim 1, in which a first nitrogen product is withdrawn from the lower pressure rectification column, and at least one second nitrogen product, either in gaseous or liquid state, is withdrawn from the higher pressure rectification column, and the oxygen produced at the bottom of the lower pressure rectification column is less than about 90% pure.

10. An apparatus for the separation of air, comprising:

a double rectification column, comprising a higher pressure rectification column having a first inlet for a first stream of purified, compressed, gaseous air at a temperature suitable for its separation by rectification, and a lower pressure rectification column which has a first inlet for a flow of oxygen-enriched liquid air communicating directly or indirectly with the higher pressure rectification column, and which is in heat exchange relationship with the higher pressure rectification column through a condenser-reboiler to provide liquid nitrogen reflux for the separation and an upward flow of vapor in the lower pressure rectification column, a vaporizer for at least partially vaporizing a stream of the oxygen-enriched liquid air in indirect heat exchange with a second stream of the purified, compressed, gaseous air;

a second inlet for air to an intermediate mass exchange region of the higher pressure rectification column communicating with an outlet for condensed air from the vaporizer;

a heat exchanger for warming a stream of vaporized oxygen-enriched liquid air formed by said indirect heat exchange with the second stream of purified, compressed gaseous air; and a turbine for expanding the warmed, vaporized second stream of oxygen-enriched liquid air with the performance of external work, having an outlet communicating with the lower pressure rectification column.

11. The apparatus as claimed in claim 10, in which the turbine is coupled to a booster-compressor for raising the pressure of the second purified, compressed, gaseous air stream.

* * * * *